US006131292A

United States Patent [19]

Reddig

[11] Patent Number: 6,131,292

[45] Date of Patent: Oct. 17, 2000

[54] UTILITY KNIFE

[75] Inventor: Bernd Reddig, Drebber, Germany

[73] Assignee: Reddig GmbH, Drebber, Germany

[21] Appl. No.: 09/300,353

[22] Filed: Apr. 27, 1999

[30] Foreign Application Priority Data

May 5, 1998 [DE] Germany ..... 198 19 915

[51] Int. Cl.[7] ..... B26B 3/08

[52] U.S. Cl. ..... 30/331; 30/330

[58] Field of Search ..... 30/162, 163, 335, 30/336, 157, 125, 337, 330, 331; 16/110.5; 81/177.4

[56] References Cited

U.S. PATENT DOCUMENTS

| | | | |
|---|---|---|---|
| 5,864,952 | 2/1999 | Chung | 30/331 X |
| 5,940,970 | 8/1999 | D'Ambro et al. | 30/330 X |
| 5,979,057 | 11/1999 | Chao | 30/162 X |

FOREIGN PATENT DOCUMENTS

| | | |
|---|---|---|
| 0196437 | 10/1986 | European Pat. Off. . |
| 4134098 | 5/1992 | Germany . |

*Primary Examiner*—Douglas D. Watts
*Attorney, Agent, or Firm*—W. F. Fasse; W. G. Fasse

[57] ABSTRACT

A utility knife has two shells that are pivoted or hinged to each other at one end to permit opening the knife handle formed by the shells for insertion or replacement of a knife blade. The two shells are interlocked with each other by a latching mechanism, including a stationary section in one shell and a rotatable section in the other shell. The rotatable section has a spring elastic bail that engages the stationary section and an operating member for disengaging or engaging the rotatable member from the stationary stop bar. In the interlocking position the operating member is recessed in a recess in the surface of one of the shells. When the knife is used, the operator's hand provides additional safety by keeping the operating member in its recess and thus the two shells interlocked.

19 Claims, 3 Drawing Sheets

UTILITY KNIFE

This application is based on and claims the priority under 35 U.S.C. §119 of German Patent Application 198 19 915.5, filed on May 5, 1998, the entire disclosure of which is incorporated herein by reference.

FIELD OF THE INVENTION

The invention relates to utility knives with replaceable or exchangeable blades. Such knives are used for cutting flat materials such as floor coverings, paper or the like.

BACKGROUND INFORMATION

Utility knives are conventionally formed of two shells that are hollow and are hinged to each other to form a hollow handle. The hinge is usually provided at one end of the two shells while a blade mounting is arranged at the opposite end. The blade mounting holds a knife blade so that it partially protrudes from the handle. The two shells are normally interlocked after a blade has been inserted into the blade mounting so that an unintended opening of the knife is prevented.

The blades are subject to heavy wear and tear and thus must be frequently replaced. It is necessary to open the knife handle for the blade exchange, whereupon the two shells must again be interlocked to form the hollow handle in which spare blades and/or used blades may be stored. The loose storage of blades which are quite sharp, inside the hollow handle may be dangerous, especially when changing a blade. The shells must be opened for a blade changing. In order to open the hollow shells, the shells are conventionally screwed to each other at least at one point away from a hinged connection between the two shells. The hinged connection is so positioned that the blades can be folded away from each other in their longitudinal direction once the screw connection has been released. The screw connection usually includes a threaded hole in one of the shells, while the other shell is provided with a screw having a knurled head rotatably held in a hole in the other shell. By rotating the screw in one or the other direction the shells may be interlocked or released as disclosed in European Patent 0,196,437.

A screw connection provides the desired rigidity of the interlocking of the two shells and the holding of the blades. However, a screw connection once tightened is not necessarily readily releasable even if the screw has a knurled head so that using a tool may become necessary. Additionally, unscrewing the shells from each other and then again screwing the shells together takes time and is not efficient. Moreover, the knurled head of the screw has a tendency to be in the way, either in a plane in the middle between the two shells or on one side of one shell. In both instances the knurled head protrudes outside of the knife handle contour. Thus, the protruding screw head interferes with properly holding the knife, especially when the diameter of the screw head is larger than the cross-sectional width of the shell handle. Such diameter is desirable for operating the screw but not necessarily convenient for handling or rather holding the knife handle. Further, when opening the handle, one must pay attention that the spare blades do not fall out of the shell. Thus, there is room for improvement in such utility knives.

OBJECTS OF THE INVENTION

In view of the foregoing it is the aim of the invention to achieve the following objects singly or in combination:

- to provide a utility knife with a rapid interlock mechanism which assures the required rigidity of the interlocked shells in forming a hollow handle for holding an exchangeable blade;
- to construct the interlock in such a way that blades may be rapidly exchanged without any danger;
- to construct the interlock in such a way that it does not have any parts that protrude outside the surface planes of the knife handle forming shells; and
- to make the interlocking mechanism or at least its main rotatable latch section exchangeable.

SUMMARY OF THE INVENTION

A knife blade according to the invention is characterized in that a fixed latch section is mounted inside one shell while a rotatable, preferably exchangeable latch section is mounted in the other shell so that an operating member is positioned in a recess of the other shell, whereby the outer surface of the operating member is flush with the respective outer shell surface when the shells are interlocked. The operating member is connected to a journal member which in turn carries a latching member which engages the stationary latch section when the operating member is recessed and which releases the stationary latch section and the respective shell when the operating member is lifted out of the recess.

Preferably, the latching member is made of a spring elastic material that on the one hand is stiff enough to hold the two shells together and to hold the blade in place in an interlocked position, while at the same time readily yielding to a lifting of the operating member for disconnecting the two shells from each other to the extent that they can be sufficiently opened for a blade insertion or blade exchange.

It is an advantage of the invention that the operating member does not interfere with holding the knife handle formed by the shells. A further important advantage is seen in that the operating member cannot accidentally release itself because when the knife is held by the operator, the operator's hand securely holds the operating member in its recess.

BRIEF DESCRIPTION OF THE DRAWINGS

In order that the invention may be clearly understood it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
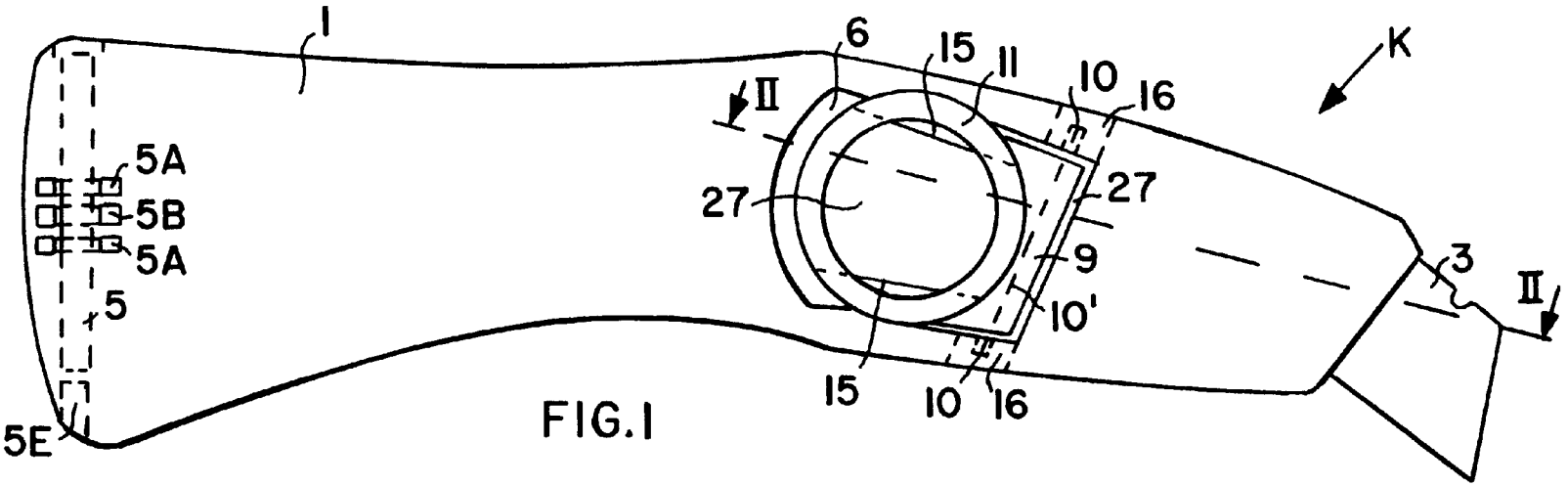
FIG. 1 is an elevational side view of a utility knife according to the invention showing a ring forming an operating member for actuating a shell interlocking mechanism.
Figure 2:
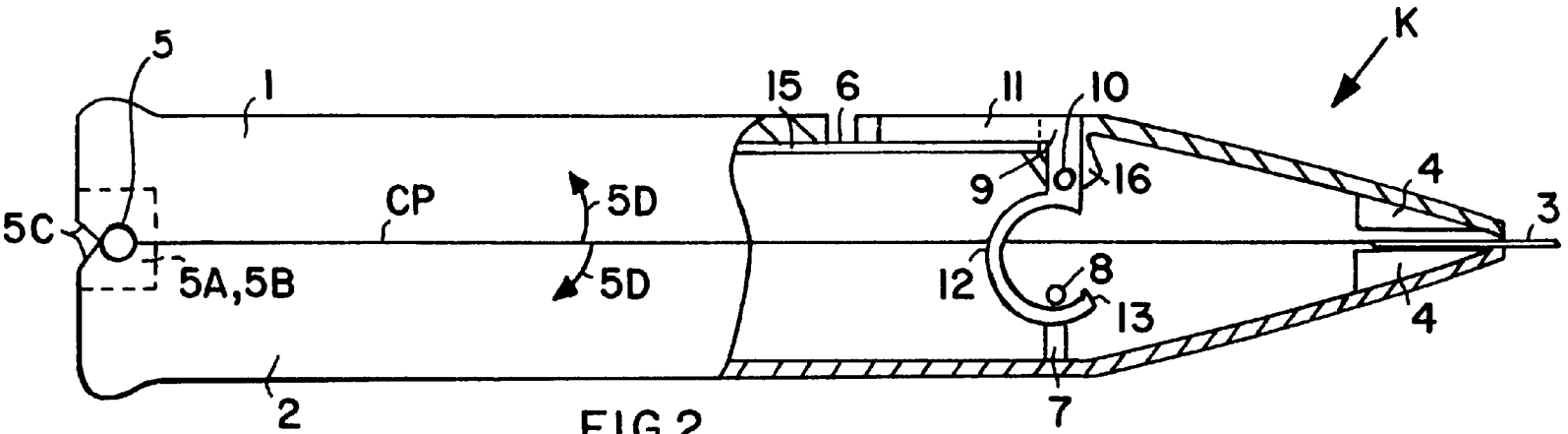
FIG. 2 is a top plan view partially in section, whereby the sectional plane extends along line II—II in FIG. 1.

FIGS. 1 and 2, viewed in conjunction, show a utility knife K having two shells 1 and 2. Shell 2 is referred to as one shell, while shell 1 is referred to as the other shell. Both shells 1 and 2 are hinged to each other at one end by a hinge pin 5 passing through hinge elements 5A and 5B rigidly secured to the inner surface of the respective shell. The shell end walls are beveled at 5C to permit a sufficient opening of the shells as indicated by the arrows 5D for exchanging a blade 3 mounted in a blade mounting 4 at the opposite end of the knife K. Preferably, one of the hinge blocks 5B is secured to one inner surface of one shell while the other two hinge blocks 5A are an integral part of the molded other shell, whereby these blocks project mutually into the other shell and one block is positioned between the two other blocks in the closed position of the shells. The holes in the hinge blocks receive the hinge pin 5. The hinge pin is preferably inserted with a spring elastic fit so that it will hold itself in place, but so that it may be pushed out of the hinge blocks if necessary, for example by inserting a pin into a hole 5E.

Instead of the just described hinge connection between two shells, for example deep drawn metal shells, it is possible to use a snap-in mechanism which is particularly suitable for molded shells of plastic materials, whereby one shell will be provided with two projections which engage grooves in the opposite shell with a spring elastic fit. The shell edges are provided with lateral guide rims which engage each other so that a lateral unintended displacement in a central plane CP is not possible even if the pin 5 should be withdrawn.

According to the invention the two shells 1 and 2 are releasably interlocked preferably in a spring elastic yet sufficiently rigid manner by a stationary latch section 7, 8 mounted in the one shell 2 and cooperating with a rotatable latch section 9, 10, 11 and 12 to be described in more detail below. The rotatable latch section is journalled in the other shell 1. For this purpose the shell 1 is provided with a recess 6 that is deep enough to permit a flush mounting of an operating member 11, whereby a shelf 15 is provided under the recess 6. The shelf 15 permits resting the operating member 11 on the shelf 15 when the operating member 11 is in a recessed position. The recess is provided with a hole 27 for the insertion of a finger for lifting the operating member 15 out of the recess 6 for disengaging the interlocking to open the shells.

Figure 3:
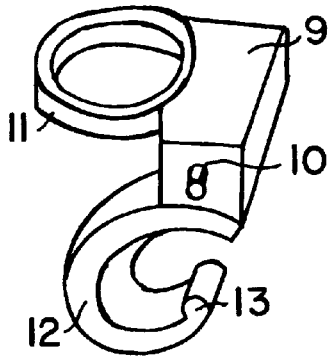
FIG. 3 is a perspective view of one embodiment of a rotatable latch section according to the invention.
Figure 4:
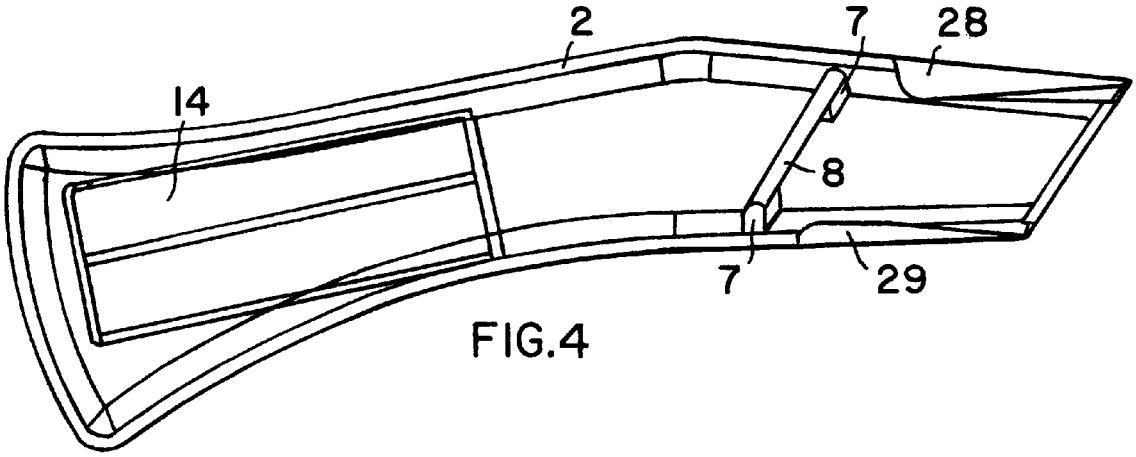
FIG. 4 is a side view into the one shell that carries the stationary locking section and which is provided with a compartment for knife blades.

The rotatable latching section includes a journal member 9, 10, a latch member 12 secured to one side of the journal member 9 and facing into a hollow enclosed by the two shells 1, 2 forming the handle. The latching section further includes the above mentioned operating member 11 secured to another side of the journal member 9 whose journal pins 10 engage shell journal bearings 16 which are arranged opposite each other in the other shell 1 and in axial alignment relative to a journal axis 10' formed by the journal pins 10 which reach into an opening or bore in the journal bearings 16 in which the pins 10 are rotatably received. The pins 10 may be an integral part of the base body forming the journal member 9 or they may be inserted with a press fit into respective bores in the journal member 9. The length of the protruding portion of the journal pins 10 is sufficient if these pins are about 2 mm long. The operating member 11 is formed, for example, as a ring that acts as a lever to swing the journal body 9 either clockwise about the journal axis 10' to disengage the rotatable latching section from the stationary latching section or counterclockwise to engage the two latch sections that form the interlocking mechanism. The operating member 11 is flush with the upwardly facing surface of the journal body 9 as best seen in FIG. 3. The inwardly facing side of the journal body 9 carries a spring elastic yet sufficiently rigid bail 12 functioning as a latching member that engages a crossbar 8 mounted in a fixed position by two uprights 7 as best seen in FIGS. 2 and 4. The latch member 12 in the form of a spring bail is either made of elastically yielding metal or a suitable plastic material that can function as a movable latch. Preferably, the latch bail 12 is curved to form an arc that is part of a circle or of an ellipsis, whereby it is preferred that the arc extends over more than 180° preferably 190° so that a free end of the latch bail 12 that is provided with a bead 13 can solidly engage the stationary stop bar 8.

Figure 5:
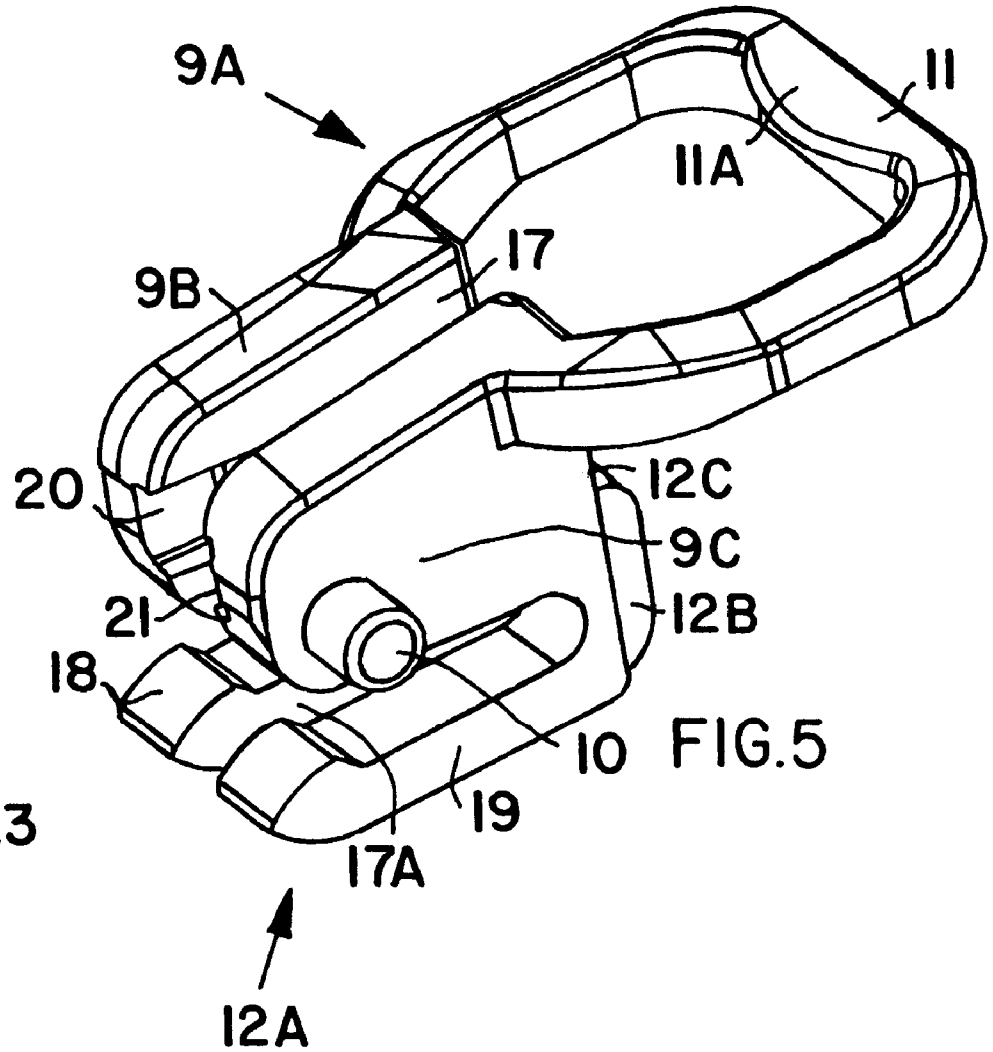
FIG. 5 is a perspective view of another embodiment of a rotatable latch section.

The latch bail 12 can have different configurations, for example as shown in FIG. 5 showing a latch bail 12A. Moreover, for facilitating the insertion of the journal pins 10 into the journal bearings 16, it is preferred that the journal body 9A is divided into two sections or portions 9B and 9C with a gap 17 therebetween as shown in FIG. 5. The two sections 9B and 9C are then held together only by the operating member 11 if the latch bail 12A is also divided into two legs 18 and 19 that have a back wall 12B which may be either one wall that interconnects the two sections 18 and 19 or it may also be divided. The back wall 12B formed as a single piece will be sufficiently flexible to push the legs 18 and 19 and the body portions 9B and 9C together for the above mentioned insertion of the pins 10 into the bearing 16. The embodiment shown in FIG. 5 is preferably made by injection molding of a suitable plastic material. The pins 10 in FIG. 5 may be replaced by bearing holes in the body sections 9B, 9C. The pins then are fixed as part of the journal bearings 16.

Figure 6:
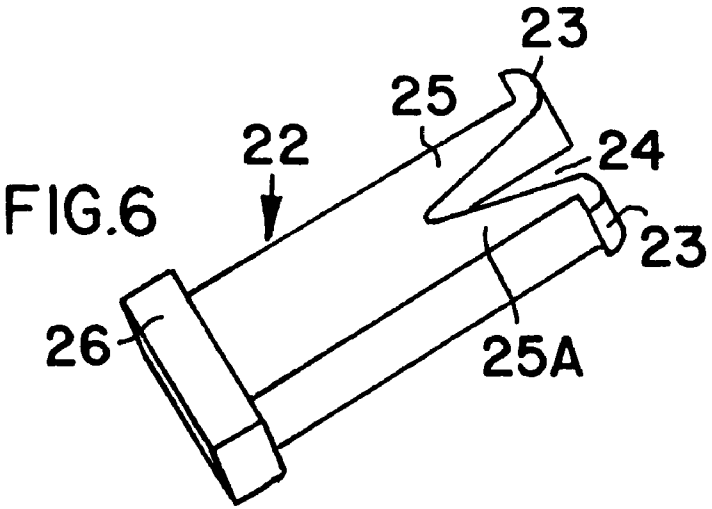
FIG. 6 is a spreader element for keeping the rotatable latch section journalled in the journal bearings.

As seen in FIG. 5, the inwardly facing surfaces of the portions 9B and 9C are provided with grooves 20 and 21 for receiving a spreader member 22 shown in FIG. 6. Once the rotatable latching section 9A is inserted into the other shell 1, the spreader member 22 is inserted to prevent an unintended movement of the sections 9B and 9C toward each other, thereby preventing any dislodgement of the journal pins 10 from the journal bearings 16.

FIG. 6 shows the spreader member 22 having a notch 24 between two flexible prongs 25 and 25A. Each of these prongs has a free end with a bead 23. Opposite the beads 23 the spreader member 22 has a stop portion 26 that limits the insertion of the member 22 into the grooves 20 and 21 in such a position that the beads 23 may engage the back wall 12C of each of the two body portions 9B and 9C. Due to the notch 24, the two prongs 25, 25A may be slightly pushed toward each other for the insertion of the member 22 into the grooves 20, 21 so that the beads 23 may slide along these grooves until the stop 26 bears against the sides of the portions 9B and 9C. When the beads 23 emerge from the grooves, the prongs 25, 25A snap away from each other and engage the beads 23 behind the walls 12C. Thus, the spreader member 22 is rigidly engaged in the gap 17 so that the portions 9B and 9C cannot be pressed toward each other unless the spreader member 22 is removed again by pushing the two beads 23 toward each other and pulling the member 22 out of the grooves 20, 21. The spreader member 22 is so dimensioned that it fits accurately into the space provided by the gap 17 and the grooves 20 and 21 so that this space is completely filled to prevent an unintended withdrawal of the journal pins 10 from the journal bearings 16.

In FIG. 5 the operating member 11 has a projection 11A under which a finger may be inserted for pulling the operating member 11 upwardly for rotating the spring bail legs 18 and 19 counterclockwise,thus disengaging these spring bails from a stop bar 8 not shown in FIG. 5.

Referring to FIG. 1, the recess 6 is positioned approximately halfway between the ends of the knife handle and the hole 27 in the shell wall next to the recess 6 between the shelves 15 extends from the recess 6 toward the blade holding end of the knife K. In this position the operator's hand will tend to press the operating member 11 into the recess 6 and against the shelves 15. The depth of the recess 6 is sufficient so that the outer surface of the operating member 11 will be flush with the outer surface of the shell 1.

The journal bearings 16 in the shell 1 are positioned on either side of the journal body 9 as best seen in FIG. 1. These journal bearings may actually be formed as U-shaped configurations so that one side of the bearing forms an opening for pushing the journal pins 10 into the bottom of the open U-shaped configuration. In that case the journal body 9 does not require any ability, see FIG. 3, for compressing for the insertion of the pins 9 into the bearings 16 as is the case in the embodiment of FIG. 5. The fit of the pins 10 is such that normally the rotatable latch section will be held in the latched position shown in FIG. 2 and only upon application of a clockwise directed force to the operating member 11 can the latch bail 12 be rotated clockwise for disengagement of the free bead end 13 from the stop bar 8. Preferably, the bearings 16 or the groove for the insertion of the journal pins 10 can be arranged at a slant so that any tendency of the journal pins 10 to slide out of the bearings 16 is avoided. The arrangement of the shelves 15 has the advantage that the operating member 11 cannot be pressed into the hollow space between the shells 1, 2. The spacing between the two shelves 15 is sufficient to permit the insertion of a finger through the opening 27.

If the rotatable latch bail 12A is used as shown in FIG. 5, the journal bearing 16 will be provided with dead end bores into which the journals pins 10 are inserted by compressing the two portions 9B and 9C as described above.

Referring to FIGS. 2 and 4, two posts 7 carry the stop bar 8 in such an exact position above the inner surface of the shell 2 that there is sufficient space for the latching bail 12 with its bead 13 to grip under the stop bar 8. Further, the spacing between the two upright posts 7 will be such that the entire width of the latch bail 12 fits between the two upright posts 7. Incidentally, FIG. 4 shows a wall extension 28 on which the operator's thumb may rest and a wall extension 29 against which the hand of an operator may rest.

The engagement of the free end of the latch bail 12 with the bead 13 under the stop bar 8 is improved when the journal axis 10' is positioned slightly to the right of a vertical plane passing through the stop bar 8. In other words, the position of the journal axis 10', or at least a portion thereof, should be closer to the front end of a knife handle than the stop bar 8 to provide a dead point that must be overcome by lifting the operating member 11 for disengaging the shells 1, 2.

Referring again to FIGS. 1 and 2, the operation of the present knife for inserting or replacing a blade 3 will now be described. By lifting the operating member 11, the rotatable latching section with its elements 9, 10 and 12 will turn clockwise by less than 90° about the journal axis 10' and thus about the journal pins 10 to thereby release the free end of the spring bail 12 from the stop bar 8, whereupon the two shells 1, 2 may be turned away from each other about the hinge pin 5 as indicated by the arrows 5D in FIG. 2. The knife blade 3 may now be removed and a new blade inserted between the blade mounts 4, whereupon the two shells 1 and 2 can be turned toward each other and the ring 11 pressed downwardly into the recess 6, whereby the front end of the bail 45 again snaps under the stop bar 8 with the bead 13 engaging the side of the stop bar 8 facing toward the front end of the knife. This engagement between the latch bail 12 and the stop bar 8 is an elastic snap-in engagement which interlocks the two shells 1 and 2.

The bead 13 makes sure that an unintended release without any application of a force to the ring 11 is prevented. Further, by positioning the journal axis 10' closer to the knife front end than the stop bar 8 as mentioned above, the interlocking is further enhanced.

When an operator holds the knife for working, the operator's hand surrounds the handle formed by the shells 1 and 2 so that the operating member 11 bears against the inner surface of the operator's hand, thereby making certain that the operating member 11 cannot unintentionally move out of the recess 6. A dead point may be also established by the engagement of the bead 13 with the stop bar 8. The inner diameter of the operating member 11 is sufficient for the insertion of a finger for the lifting of the ring when the two shells are to be disengaged from each other. A finger should securely fit into the ring for properly guiding the ring into and out of the recess 6.

The position of the operating member 11 in the shell 1 shown in FIG. 1 provides a knife for a right-handed user. On the other hand, the position of the operating member 11 shown in FIG. 2 shows a knife for a left-handed user.

As shown in FIG. 4, a block of replacement blades 14 is securely held in the space of the shell 2 which will be covered by the other shell 1 that provides a similar space for enclosing the blade block 14. The space is sufficient for holding the blades individually or even in a dispenser holding several blades.

Although the operating member 11 has been described as having a ring-shape, such a shape is not critical for the present purposes. The ring could be replaced, for example by a bail that exactly fits onto the surface or into a groove of the shell 1 to laterally enclose the shell 1. The operation is the same, instead of lifting the ring, the bail would have to be lifted or depressed.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A utility knife for use with exchangeable knife blades, said knife comprising a first shell (1) and a second shell (2) forming together a hollow handle, a hinge (5) at one end of said hollow handle journalling said shells to each other for opening and closing said shells, a blade mounting at the other end of said hollow handle, a slot between said shells next to said blade mounting so that a knife blade can protrude from said hollow handle through said slot, a shell interlocking mechanism in said hollow handle for releasably interlocking said shells, said locking mechanism comprising a stationary latch section (7, 8) fixed inside one shell of said first and second shells and a rotatable latch section (9, 10, 11, 12) mounted inside the other shell of said first and second shells, said rotatable latch section comprising a journal member (9, 10), a latch member (12) secured to one side of said journal member and facing into said hollow handle when said shells are interlocked, and an operating member (11) secured to another side of said journal member (9, 10), journal bearings (16) secured in said other shell, said journal member (9) being journalled in said journal bearings (16), and a recess (6) in said one shell, said operating member (11) being received in said recess (6) in a latched position for interlocking said latch member (12) with said stationary latch section (7, 8), and wherein said operating member (11) is rotatable out of said recess (6) for unlocking said locking mechanism.

2. The utility knife of claim 1, wherein said rotatable latch section comprises a body forming said journal member (9) including two axially aligned journal pins (10) projecting from opposite sides of said body for engaging said journal bearings (16), wherein said latch member (12) comprises an open spring elastic bail (12, 12A) for engaging said stationary latch section (7, 8), wherein said operating member comprises a ring (11), and wherein said other shell (1) comprises a recessed shelf (15) and a hole (27) in said recessed shelf (15), said ring (11) resting in said recess on said recessed shelf (15) in register with said hole (27) when said spring elastic bail engages said stationary latch section (7, 8), whereby said ring is held in a position flush with an outer surface of said one shell.

3. The utility knife of claim 2, wherein said open spring elastic bail is arc-shaped extending over at least 180° of an arc.

4. The utility knife of claim 2, wherein said body forming said journal member (9) and carrying said open spring elastic bail (12, 12A) extends at an angle to a plane in which said ring of said operating member (11) extends.

5. The utility knife of claim 4, wherein said angle between said plane of said ring (11) and said body (9) is 90°+10°.

6. The utility knife of claim 2, wherein said rotatable latch section (11; 9, 10; 12) is exchangeably mounted in said journal bearings (16).

7. The utility knife of claim 2, wherein said open spring elastic bail (12) comprises a free end for engaging said stationary latch section (7, 8), said free end having a bead (13), said stationary latch section (7, 8) having an opening through which said bead (13) snaps elastically when said first and second shells are interlocked by operating said ring (11).

8. The utility knife of claim 2, wherein at least said body of said journal member (9) comprises two body portions (9B, 9C) separated by a gap (17), whereby said two body portions can be pressed toward each other thereby narrowing said gap by an elastic yielding of said body portions (9B, 9C) for inserting said journal pins (10) in said journal bearings (16) and for snapping said journal pins (10) into said journal bearings (16) by releasing pressure from said two body portions (9B, 9C). (FIG. 5)

9. The utility knife of claim 8, wherein said open spring elastic bail (12A) comprises two spring elastic bail legs (18, 19) extending from said body portions (9B, 9C) and separated by a slot (17A) aligned with said gap (17) for facilitating pressing said two body portions (9B, 9C) toward each other, said open spring elastic bail (12A) comprising an unslotted back wall (12B) holding said two bail legs (18, 19) together. (FIG. 5)

10. The utility knife of claim 9, wherein each of said two body portions (9B, 9C) comprises a groove (20, 21) facing into said gap (17), said knife further comprising a spreader member (22) for insertion into said gap (17) and grooves (20, 21) when said journal pins (10) are engaged in said journal bearings (16).

11. The utility knife of claim 10, wherein said spreader member (22) comprises a notch (24) to form two prongs (25, 25A) for facilitating the insertion of said spreader member (22) into said gap (17) and grooves (20, 21).

12. The utility knife of claim 11, wherein each of said two prongs (25, 25A) of said spreader member (22) comprises a lateral projection (23) for engaging said body of said journal member (9) to prevent unintended withdrawal of said spreader member (22) from said gap (17).

13. The utility knife of claim 12, wherein said spreader member (22) comprises at least one stop member end portion (26) opposite said two prongs (25, 25A) for limiting an insertion of said spreader member (22) into said gap (17).

14. The utility knife of claim 1, wherein said other shell (1) comprises reinforcements forming said journal bearings (16), said reinforcements having axially aligned openings, said journal member (9) comprising axially aligned journal pins (10) rotatably received in said openings.

15. The utility knife of claim 14, wherein said stationary latch section comprises a stop bar (8) for engagement by said latch member (12), said reinforcements forming said journal bearings (16) defining a journal axis (10') which is positioned closer toward said blade mounting (4) than said stop bar (8) to form a dead point, whereby inadvertent release of said latch member (12) from said stop bar (8) is prevented.

16. The utility knife of claim 1, wherein said stationary latch section (7, 8) comprises two upright latch elements (7) secured inside said one shell (2) with a spacing between said latch elements for receiving said latch member (12) in said spacing when said shells are interlocked, and a stop bar (8) interconnecting said upright latch elements (7) above an inner surface of said one shell (2) for holding said latch 8 member (12) in an interlocked position with said stop bar (8).

17. The utility knife of claim 1, wherein said rotatable latch section is exchangeable by withdrawing said journal member (9, 10) from said journal bearings (16).

18. The utility knife of claim 2, wherein said hole (27) in said shelf (15) has an open clearance corresponding approximately to an inner diameter of said ring of said operating member (11), whereby the clearance and the inner diameter are sufficient for an insertion of a finger for turning said ring of said operating member (11) out of said recess (6).

19. The utility knife of claim 8, wherein said journal bearings (16) comprise fixed journal pins projecting into said hollow handle, and wherein said body of said journal member (9) comprises axially aligned bearing holes in which said fixed journal pins are received.

* * * * *

UNITED STATES PATENT AND TRADEMARK OFFICE
CERTIFICATE OF CORRECTION

PATENT NO. : 6,131,292

DATED : October 17, 2000

INVENTOR(S) : Reddig

It is certified that error appears in the above-identified patent and that said Letters Patent is hereby corrected as shown below:

| | | |
|---|---|---|
| Col. 4, | line 50, | after "25," replace "25Asnap" by –25A snap–; |
| Col. 7 | line 29, | after "90°", replace "+" by --±--. |

Signed and Sealed this

Eighth Day of May, 2001

*Attest:*

Nicholas P. Godici

NICHOLAS P. GODICI

*Attesting Officer*

*Acting Director of the United States Patent and Trademark Office*